US005547007A

United States Patent [19]

Grutzner

[11] Patent Number: 5,547,007

[45] Date of Patent: Aug. 20, 1996

[54] ACTUATING DEVICE FOR CURTAIN STRIPS

[75] Inventor: Hans Grutzner, Kehrsatz, Switzerland

[73] Assignee: K. Bratschi, Silent Gliss, Muri b. Bern, Switzerland

[21] Appl. No.: 182,052

[22] PCT Filed: May 17, 1993

[86] PCT No.: PCT/CH93/00123

§ 371 Date: Jan. 14, 1994

§ 102(e) Date: Jan. 14, 1994

[87] PCT Pub. No.: WO93/24726

PCT Pub. Date: Dec. 9, 1993

[30] Foreign Application Priority Data

May 22, 1992 [CH] Switzerland ..... 1658/92

[51] Int. Cl.[6] ..... E06B 9/36

[52] U.S. Cl. ..... 160/168.1; 160/176.1; 160/900

[58] Field of Search ..... 160/168.1 V, 176.1 V, 160/900, 173 V, 174 V, 177 V, 178.1 V

[56] References Cited

U.S. PATENT DOCUMENTS 4,316,493 2/1982 Arena ..... 160/168.1 V 4,844,139 7/1989 John ..... 160/168.1 V

FOREIGN PATENT DOCUMENTS 2437040 8/1975 Germany ..... 160/900

2122675 1/1984 United Kingdom ..... 160/900

*Primary Examiner*—Blair M. Johnson

*Attorney, Agent, or Firm*—Weiser & Associates, P.C.

[57] ABSTRACT

The activation device has a cord pull (8) on which at a certain distance two catches (9) are firmly attached. Via a gear system (10) the cord pull (8) is connected to a shaft (23) which passes through sliding elements (24) and which is connected to gears arranged in the sliding elements with curtain strips (34). The curtain strips (34) can be pivoted about 180° with the shaft (23). If the curtain strips (34) are against a stop, the latter can be moved in one of the longitudinal directions of the curtain rail, in which case one of the stops (9) is engaged with the front running sliding element (24*a*). By activation of the cord pull (8) thus the curtain strips (34) can be pivoted about their longitudinal axes or moved in the longitudinal direction of the curtain rail horizontally.

7 Claims, 4 Drawing Sheets

ACTUATING DEVICE FOR CURTAIN STRIPS

BACKGROUND OF THE INVENTION

The invention relates to an activation device for horizontally moveable curtain strips which can be pivoted together about their longitudinal axis with a sliding element capable of sliding longitudinally in a curtain rail and connected to one another by distance limiters, each of which carry a freely suspended curtain strip on a pivoting axis of limited rotatability and with a drive mechanism which has a puller and a shaft which passes through the sliding elements, said shaft being capable of rotating with the puller in order to pivot the curtain strips and that in each sliding element a gear system is arranged which connects a pivot axis to the shaft.

An activation device of this type has become known through DE A 26 37 067. Here the puller is a string pull which is guided to the outside and on which the curtain strips are moved both horizontally and can also be pivoted about their vertical axes. For this activation device a special pulling carriage is necessary for horizontally moving the curtain strips, said pulling carriage itself carrying no curtain strips. In practice it has now been found that this pulling carriage even after incorporation of a suitable braking device moves inadvertently during the pivoting of the curtain strips which makes it almost impossible or very difficult to align the curtain strips uniformly.

SUMMARY OF THE INVENTION

The invention has the task of devising an apparatus of the type mentioned with which the curtain strips can be activated more precisely and which is also simpler in construction and can therefore be manufactured at lower costs. This problem is solved by the fact that the puller has two catches at a certain distance which can touch against the front runner in order to move it in the one or the other direction in the curtain rail.

In the activation device according to the invention the front runner is not moved by the shaft but rather directly with the catches of the puller which may be a string puller. When the curtain strips are moved, therefore the shaft does not have to be rotated, which signifies a significant reduction in the activation noise as well as in the torsion of the shaft. The low torsion also permits very long activation devices, e.g., with a length of 4 meters.

The gear system for transmitting the movement of the puller to the shaft may be stationary, e.g., installed on a curtain rail, which permits significantly simpler installation and cost-favorable production. The front runner can then be formed essentially like the other sliding elements. A special pulling carriage is therefore unnecessary. It is also important that in the activation device according to the invention the force to rotate the curtain strips is better separated from the force for moving the curtain strips.

Since the puller acts directly on the front runner, the curtain strips can be moved much more rapidly than with the previously known activation device and therefore the curtain can be closed more quickly. Despite these advantages the activation device according to the invention can be manufactured much more simply and with fewer parts.

Other advantageous features may be obtained from the dependent claims, the following description and the drawing. An example of embodiment of the invention is illustrated below with reference to the drawings.

DETAILED DESCRIPTION OF THE INVENTION

Figure 4:
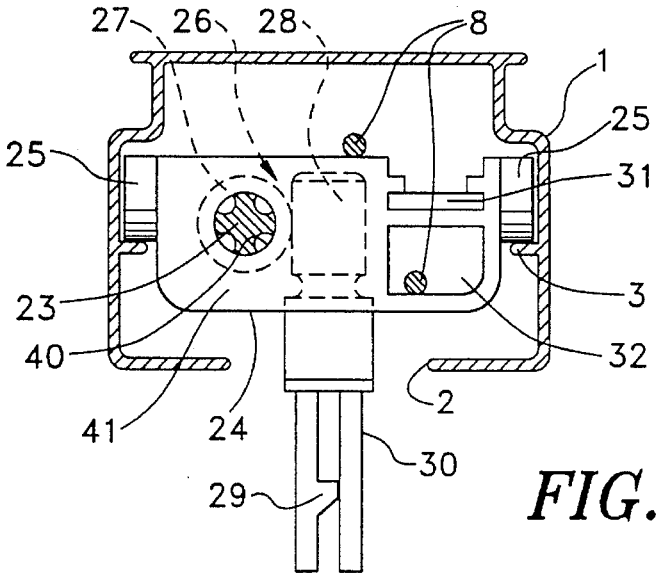
FIG. 4 is a cross-section through an activation device according to the invention.
Figure 5:
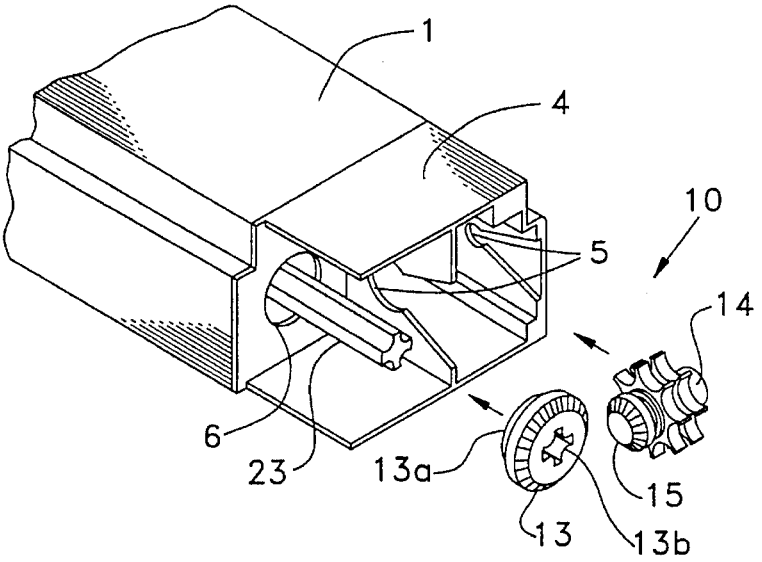
FIG. 5 is a perspective partial view of the activation device according to the invention.

The activation device has a curtain rail 1 with the cross-section shown in FIG. 4. At one end of the rail an end housing 4 is seated in which a bevel gear drive 10 is mounted. This housing 4 is closed by a lid, not shown here. At the other end of the rail 1 another end housing is installed, also not shown here, in which the direction-changing rolls 7 for a cord pull 8 are installed. Ordinarily the curtain rail 1 is mounted in front of a window on the ceiling of a building.

In the curtain rod 1 several sliding elements 24 are arranged, where the first sliding element 24*a* forms the front runner. Each sliding element 24 as well as the front runner 24*a* in each case have an axle 29 which can pivot to a limited degree and to which a curtain strip 34 is attached. The attachment here is accomplished with a cam 30 formed on the lower end of the axle 29. The sliding elements 24 are movably guided with rollers 25 on side attachments 3 of the curtain rail 1. The axles 29 of the sliding elements 24 extend to the outside down through a longitudinal slit 2 extending over the entire length of the rail 1. During the movement of the sliding elements 24, therefore the curtain strips 34 are correspondingly moved in the longitudinal direction of rail 1.

Each sliding element 24 including the front runner 24*a* has a through-going round opening 40 through which a control shaft 23 extends, which is connected in each sliding element 24 in a rotation-proof manner to a worm gear 27 of a worm gear drive 26. In the housing 41 of the sliding element 24 the axle 29 is mounted with the capability of limited pivoting and has a worm gear wheel 28 which engages with the worm 27. Upon rotation of the control shaft 23 therefore the axle 29 and therefore the curtain strip 34 attached below it are pivoted in the one or the other direction. Such worm gears are known, for example, from the applicant's EP W 0 181 465.

The pivoting of the control shaft 23 takes place via the cord pull 8 which is connected to the gear system 10 mounted in the end housing 4. This bevel gear drive 10 has a cogwheel 13 which is pushed with its through-going opening 13*b* onto shaft 23 and is connected in a rotation-proof manner to it. The cogwheel 13 is rotatably mounted with a cylindrical attachment 13*a* which engages in a circular opening 6 of the end housing 4.

Figure 6A:
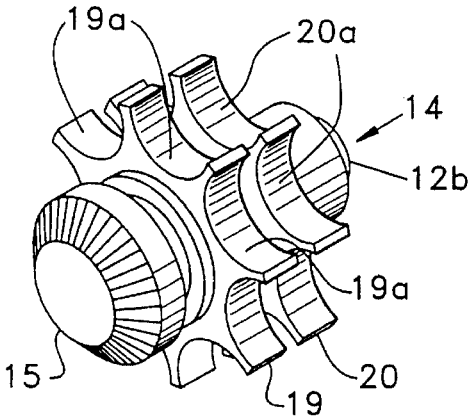
FIG. 6*a* is a perspective view of a gear part and FIG. 6*b* is a partial section through the gear part shown in FIG. 6*a*.
Figure 6B:
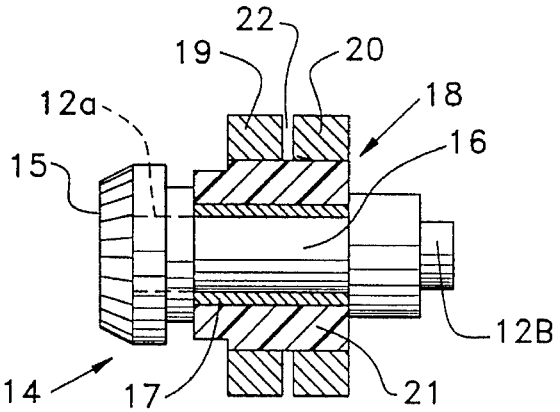

A gear part 14 shown in detail in FIGS. 6*a* and 6*b* has two slide bearings 12*a* and 12*b* arranged at a distance from one another which are inserted in the corresponding bearing positions 5 of the end housing 4 and are locked in place. The bearings 12*a* and 12*b* are shaped on a shaft 16 which carries a cogwheel 15 at one end and which is connected via a slip clutch 18 with two drive wheels 19 and 20 arranged at a distance from one another. The wheels 19 and 20 are firmly connected to a part 21 of the slip clutches 18 and thus arranged at a distance from one another in such a way that a groove 22 is formed between them in which the rope pull 8 engages in its direction-changing area, and by friction upon pulling the cord pull 8 the wheel 15 rotates in one direction or the other. With the cord pull 8, therefore, the shaft 23 can be rotated about its longitudinal axis in one or the other direction. As mentioned above, the axles 29 can be pivoted to a limited extent in both pivoting directions. If the axles 29 are pivoted as far as a stop, the control shaft 23 can no longer be turned in the same direction. The slip clutch 14 now, despite this, permits the cord pull 8 and two catches 9 firmly connected to it to move in the same direction as before. In this case, now the curtain strip 34 is moved in the longitudinal direction of the curtain rail 1, as is explained below with reference to FIGS. 1 through 3. Recesses 19*a* and 20*a* on the circumference of the wheels 19 and 20 and corresponding recesses on the direction-changing roll 7 assure that the catches 9 do not stop at the direction-changing sites.

Figure 1:
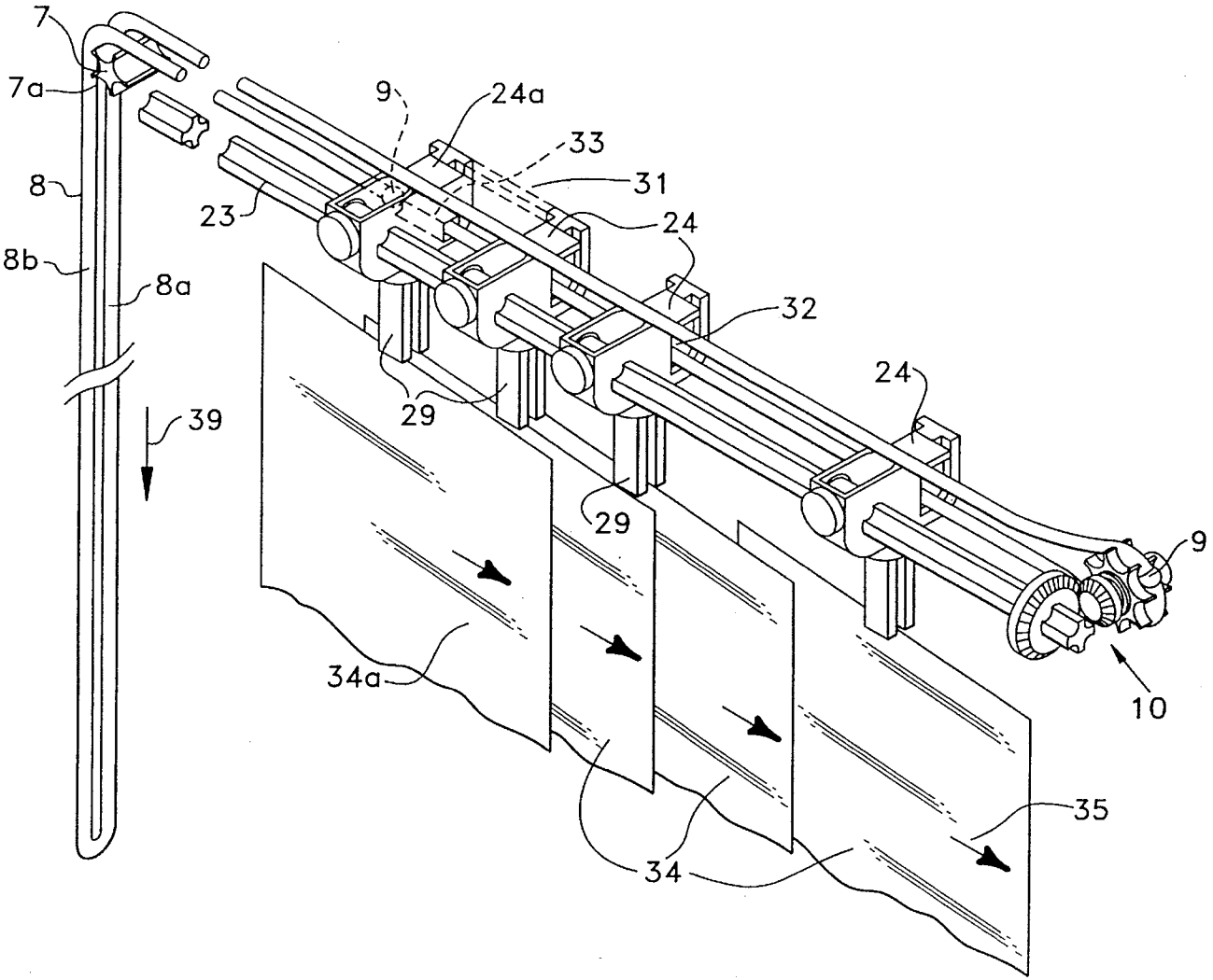
FIGS. 1 through 3 are perspective partial views of the activation device according to the invention, where some of the parts are omitted for reasons of clarity.

In the arrangement shown in FIG. 1 it is assumed that the cord pull 8 is moved downward on its strand 8*a* in the direction of the arrow 39. The catch 9 shown by a dotted line here is then moved to the right and here stops at the relatively small opening 33. The above-mentioned catch 9 pushes the front runner 24*a* to the right which moves up against the next following sliding element 24 and also pushes it to the right. The curtain strips 34 are accordingly moved to the right as shown by the arrow 35 until they are brought together in one package. The stops of the gears 26 in this case prevent a pivoting movement of the curtain strips 34. The shaft 23 is therefore stationary and the slip clutch 21 continues to rotate during the above-mentioned horizontal movement of the curtain strips 34. Upon movement of the cord pull 8 in the direction of the arrow 39 therefore the curtain strips 34 are pushed to the side and, for example, permit one to look through a window.

Figure 2:
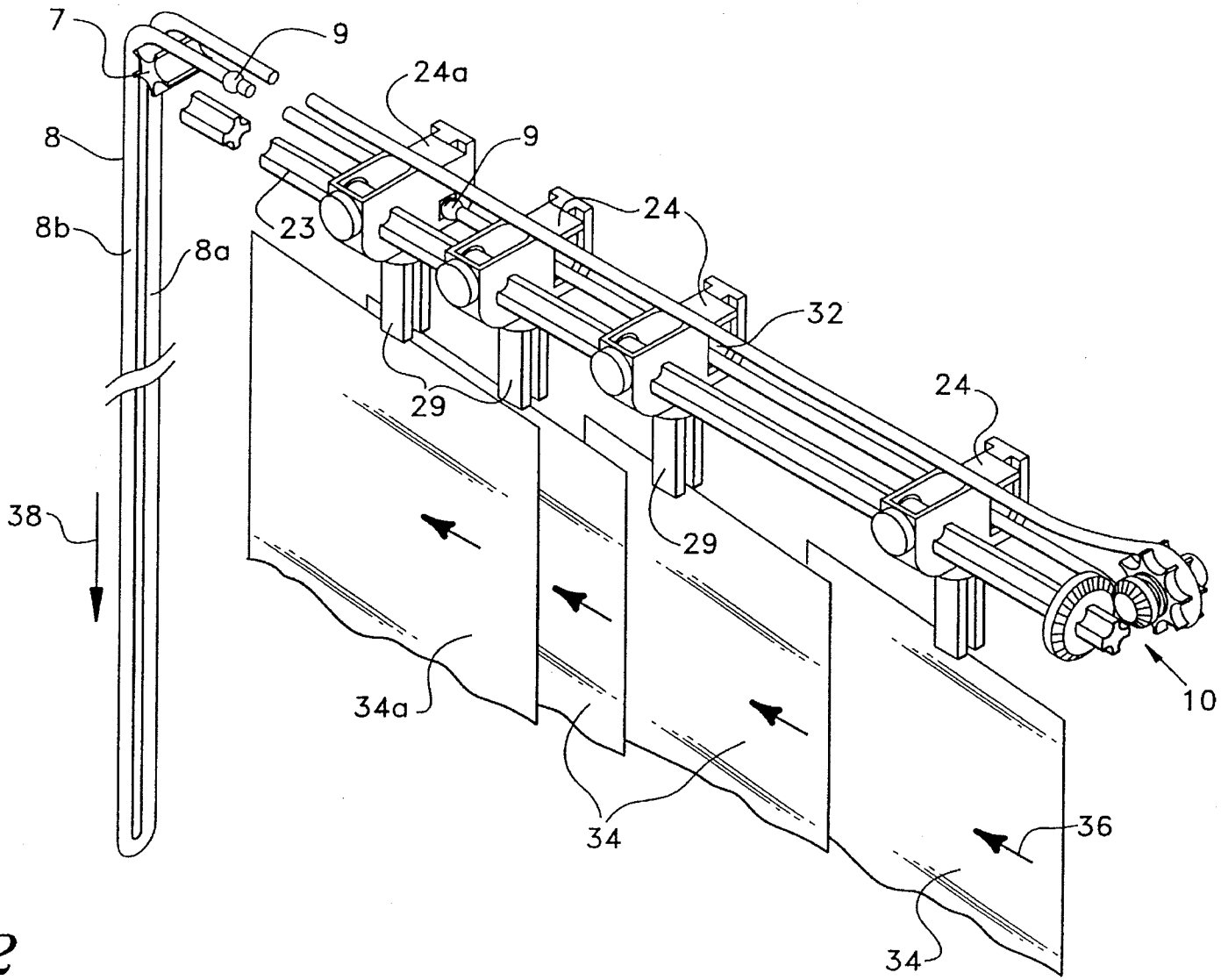

To close the curtain according to FIG. 2 the cord pull 8 is moved down on its strand 8*b* in the direction of the arrow 38. The catch 9 situated on the gear system 10 in FIG. 1 now runs around the gear part 14 and unimpededly through the relatively large openings 32 until it also comes to a stop on the right side of the front runner 24*a* as shown in FIG. 2. The front runner 24*a* is now carried along to the left by the cord pull 8 and the remaining sliding elements 24 are also moved successively to the left by the spacing device 31, which establishes longitudinal spacing between the sliding elements 24. Accordingly the curtain strips 34 are moved to the left in the direction of the arrow 36, while the latter in turn is not pivoted because of stops in the gears 26. Here also the shaft 23 is stationary during the entire longitudinal movement of the curtain strips 34 and the slip clutch 21 continues to rotate. When the curtain is closed the distances between the sliding element 24 are all the same, as determined by the spacer 31.

With the cord pull 8 the curtain strips 34 can thus be moved in both directions of the curtain rail for opening or closing the curtain where the shaft 23 is not rotated and the curtain strips 34 are not pivoted in each case.

Figure 3:
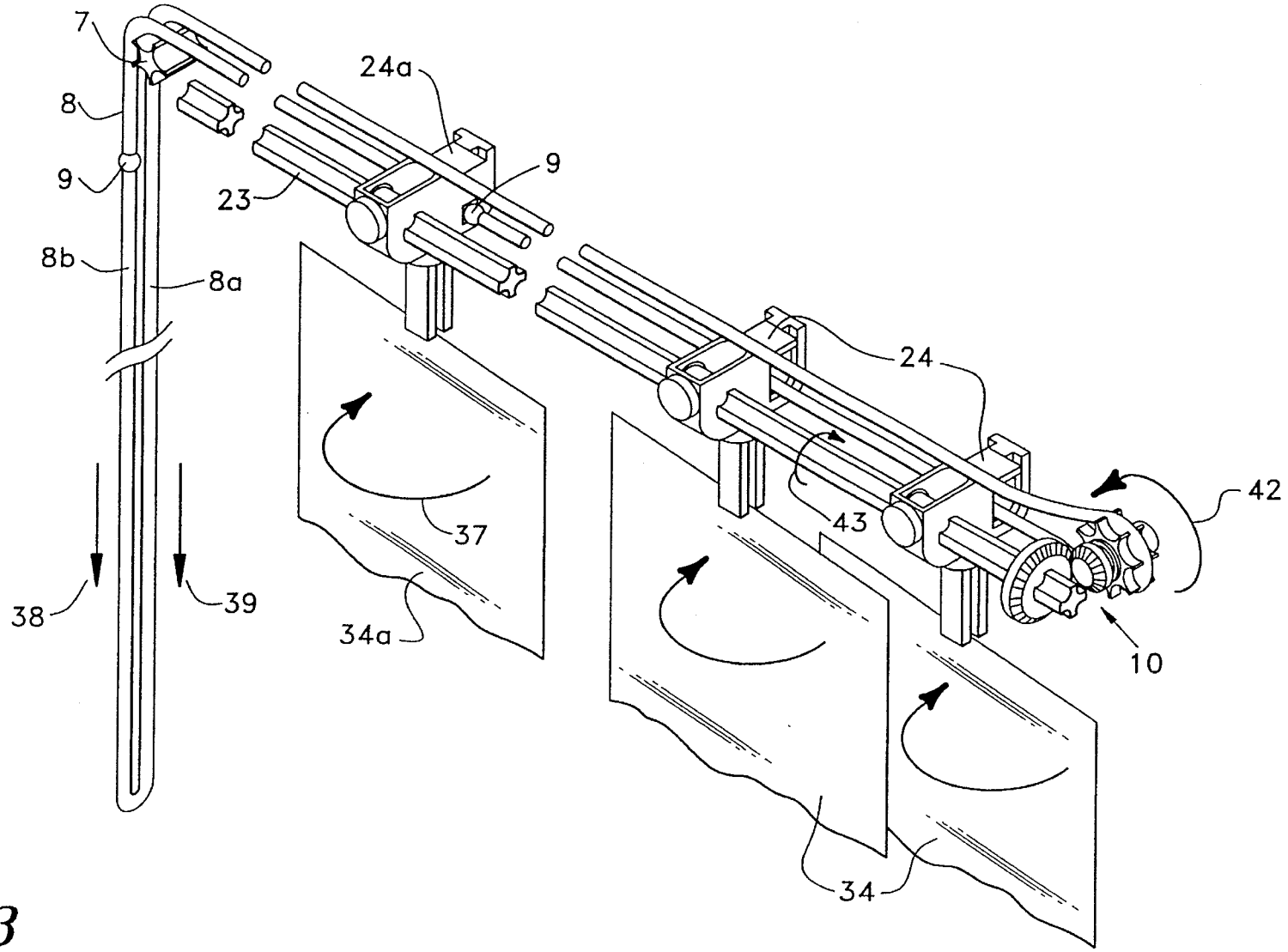

The pivoting of the curtain strips 34 is shown in FIG. 3. In the arrangement of the curtain strips 34 shown in FIG. 3, they can be pivoted in the direction of the arrow 37 but not in the opposite direction, since this is prevented by the corresponding stops in the gears 26. In order to pivot the curtain strips 34 in the direction of the arrow 37 the strand 8*a* is moved downward in the direction of the arrow 39. The catch 9 still lying against the front runner 24 as shown in FIG. 3 now moves to the right away from the front runner 24*a*.

The catches 9 now temporarily have no effect on the sliding elements 24 and accordingly the latter are not pushed in a longitudinal direction of the curtain rail 1. The cord pull 8 now because of its friction on the gear part 14 rotates it in the direction of the arrow 42 around its axis of rotation. Since now a rotation of the shaft 23 is not prevented by the stops in the gears 26, the slip clutch 21 engages the cogwheel 15 and accordingly the shaft 23 is rotated in the direction of the arrow 43. The gears 26 transmit the motion of the shaft 23 to the curtain strips 34 which are pivoted as desired in the direction of the arrow 37. In an intermediate position the curtain strips 34 run transversely to the curtain rail 1. In an end position the curtain strips 34 are pivoted with respect to the arrangement shown in FIG. 3 by about 160° and moreover cannot be pivoted further because of stops in the gears 26. If by starting from this end position the strand 8*b* is moved down in the direction of arrow 38, the curtain strips 34 pivot in the opposite direction of arrow 37 to the end position shown in FIG. 3. Each desired intermediate position of the curtain strips 34 is possible directly. It is important to note that during the above mentioned pivoting movements of the curtain strips 34 the catches 9 do not engage the front runner 24*a* and move it. The distance between the catches 9 therefore cannot go below a certain value. The distance is dependent in particular on the translation of the gears 26. The catches 9 are preferably firmly attached to the cord pull 8 so that then the stated distance can be firmly set. The pivoting of the curtain strips 34 therefore also takes place through activation of the cord pull 8. As a rule the activation is done by hand but motor activation is certainly not excluded. It goes without saying that the cord pull 8 may also be another suitable activation device such as an endless chain.

I claim:

1. An activation device for a curtain rail having a guide shaft defining a longitudinal axis, and a plurality of sliding elements having pivoting axles for receiving a plurality of curtain strips and for simultaneously pivoting the curtain strips about their longitudinal axes;

wherein the sliding elements are connected by a plurality of spacers and are capable of guided displacement along the longitudinal axis of the guide shaft responsive to interaction between the sliding elements and the spacers, and wherein the sliding elements further comprise a drive mechanism operatively associated with the pivoting axles and the guide shaft;

wherein the activation device further comprises a puller having a cord pull with two catches fixed to the cord pull at a spaced distance from one another, and wherein the cord pull passes through the sliding elements so that a first one of the sliding elements is situated between the two catches, and so that contact between either one of the two catches and the first one of the sliding elements moves the first one of the sliding elements in a specified direction along the curtain rail; and wherein the drive mechanism includes a gear system connecting the puller to the guide shaft, and fixed to an end housing associated with the curtain rail, and wherein the gear system further comprises a slip clutch and a meshed tooth connection between the puller and the guide shaft.

2. The activation device of claim 1 wherein the catches are bulges formed on the cord pull, wherein the first one of the sliding elements has an opening for passing the cord pull which is smaller than the bulges, and wherein each of the sliding elements other than the first one of the sliding elements has an opening for passing the cord pull which is larger than the bulges.

3. The activation device of claim 1 wherein the cord pull is a continuous loop cord pull.

4. The activation device of claim 1 wherein the drive mechanism includes two wheels spaced a predetermined distance from one another, and wherein the cord pull is frictionally associated with and located between the two wheels.

5. The activation device of claim 1 wherein the gear system is associated with a first end of the curtain rail and wherein the cord pull is associated with a second, opposing end of the curtain rail.

6. The activation device of claim 1 wherein the first one of the sliding elements is associated with an end of the curtain rail.

7. An activation device for a curtain rail having a guide shaft defining a longitudinal axis, and a plurality of sliding elements having pivoting axles for receiving a plurality of curtain strips and for simultaneously pivoting the curtain strips about their longitudinal axes;

wherein the sliding elements are connected by a plurality of spacers and are capable of guided displacement along the longitudinal axis of the guide shaft responsive to interaction between the sliding elements and the spacers, and wherein the sliding elements further comprise a drive mechanism operatively associated with the pivoting axles and the guide shaft;

wherein the activation device further comprises a puller having a cord pull with two catches fixed to the cord pull at a spaced distance from one another, and wherein the cord pull passes through the sliding elements so that a first one of the sliding elements is situated between the two catches, and so that contact between either one of the two catches and the first one of the sliding elements moves the first one of the sliding elements in a specified direction along the curtain rail; and wherein the drive mechanism operatively connects the puller to the guide shaft to allow for separate guided displacement of the sliding elements and pivoting of said curtain strips about their longitudinal axis.

* * * * *